United States Patent [19]

Zambano et al.

[11] Patent Number: 4,830,200

[45] Date of Patent: May 16, 1989

[54] DISHWASHER BASKET FOR BABY BOTTLE PARTS

[75] Inventors: Norma Zambano, White Plains; Lina Lorusso, Mount Vernon, both of N.Y.

[73] Assignee: Lillan Vernon Corporation, Mount Vernon, N.Y.

[21] Appl. No.: 200,047

[22] Filed: May 31, 1988

[51] Int. Cl.[4] ..... A47F 5/14

[52] U.S. Cl. ..... 211/181; 211/41

[58] Field of Search ..... 211/181, 41, 74, 71, 211/126; 134/166 R, 135, 137, 200; 220/19, 69

[56] References Cited

U.S. PATENT DOCUMENTS

| | | | |
|---|---|---|---|
| 921,694 | 5/1909 | Hall | 211/181 X |
| 2,152,456 | 3/1939 | Barrie | 211/41 X |
| 2,873,861 | 2/1959 | Jensen | 211/194 X |
| 4,118,081 | 10/1978 | Barrientos | 211/41 X |
| 4,498,594 | 2/1985 | Elder | 211/41 X |
| 4,621,739 | 11/1986 | Heymann et al. | 211/181 X |
| 4,748,993 | 6/1988 | Llewellyn | 211/181 X |

*Primary Examiner*—Reinaldo P. Machado
*Assistant Examiner*—Sarah A. Lechok Eley
*Attorney, Agent, or Firm*—Salter & Michaelson

[57] ABSTRACT

A dishwasher basket for baby bottle parts having a wire rack construction, and comprising a bottom container for receiving caps, rings, pacifiers, etc., and a top container pivotally mounted on top of said bottom container so as to provide a hinged cover therefor, said top container having oppositely disposed end walls having at least one pair of spaced wires pivotally connected to the upper side of one of said end walls and extending across to the opposite end wall, with the spacing between said wires being such that the teat end of a nipple may extend therebetween while at the same time capturing said nipple in said top container.

5 Claims, 1 Drawing Sheet

DISHWASHER BASKET FOR BABY BOTTLE PARTS

BACKGROUND OF THE INVENTION

The present invention relates generally to dishwasher baskets, and particularly baskets that permit baby-bottle parts, such as nipples, caps, rings, pacifiers and the like, to be washed, rinsed and dried in a dishwasher.

The problem in washing baby-bottle parts such as these in a dishwasher is that the parts are so relatively small and light that if simply positioned on the conventional dishwasher racks, they tend to bounce around during the washing, rinsing and drying cycles, thus creating the likelihood of possible damage to dishes, glasses, etc., that may be in the dishwasher at the same time, as well as possible damage to the dishwasher itself.

In order to overcome this problem, special racks or baskets have been provided for receiving such bottle parts and maintaining them segregated from other articles that may be in the dishwasher while at the same time preventing the parts from flying about in the dishwasher and causing possible damage to the dishwasher mechanism. The patent to ELDER, namely, U.S. Pat. No. 4,498,594 dated Feb. 12, 1985, is illustrative of such a basket or rack, but in the ELDER patent upwardly extending prongs or pins are provided for receiving and positioning the nipples and other parts, thus making it somewhat laborious and time consuming to load the basket or rack. There therefore still exists a need for such a basket or rack that is quick and convenient to load and unload and that is easy and economically feasible to manufacture.

BRIEF SUMMARY OF THE INVENTION

In accordance with the present invention, there is provided a basket or rack having a bottom container comprising a bottom, side, and end walls, and a top container comprising a bottom and end walls. The top container is hingedly mounted to the upper edge of one of the end walls of the bottom container, and clasp means are provided at the free opposite end of the top container bottom wall for releasably securing said end to the bottom container. Thus, when the top container is in its closed position on the bottom container, the bottom wall of the top container functions as a cover for the bottom container which may be easily opened or closed to permit access to said bottom container.

The top container further comprises at least one pair of generally parallel, spaced wires that are pivotally connected to the upper edge of one of the top container end walls and that extend across to the opposite top container wall with clasp means provided at their free ends, whereby said spaced wires may selectively be swung upwardly to an open position or swung downwardly to a closed position wherein their free ends releasably engage the adjacent top container end wall. The spacing between the wires is such that the teat end of a nipple may extend therebetween, while at the same time the base of the nipple is retained in engagement with the bottom wall of the top container, thus maintaining the nipple in captured relation within the top container. Preferably there are two pairs of spaced wires, and hence a plurality of nipples may be mounted and maintained in the top container, with one row of nipples being retained between one pair of wires and with another row of nipples being maintained between the other wires. Thus the relatively soft and lightweight nipples are maintained segregated from the other bottle parts which are positioned within the bottom container when the basket is placed within the dishwasher.

Another feature of this invention is the fact that the pivotal mounting of the top container to the bottom container is such that former may be readily separated from the latter when desired for any reason, and the same is true of the pivotal connection between the spaced wires and the top container.

It is therefore an object of this invention to provide a dishwasher basket for bottle parts wherein special mounting and retaining means are provided for receiving the relatively soft and lightweight nipples and maintaining same segregated from the other bottle parts that are being washed.

Another object is the provision of a dishwasher basket having top and bottom containers, the former being releasably and pivotally connected to the latter.

Another object is to provide a dishwasher basket of the character described that is simple and economically feasible to manufacture and that is easy and effective in use.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT OF THE INVENTION

Figure 1:
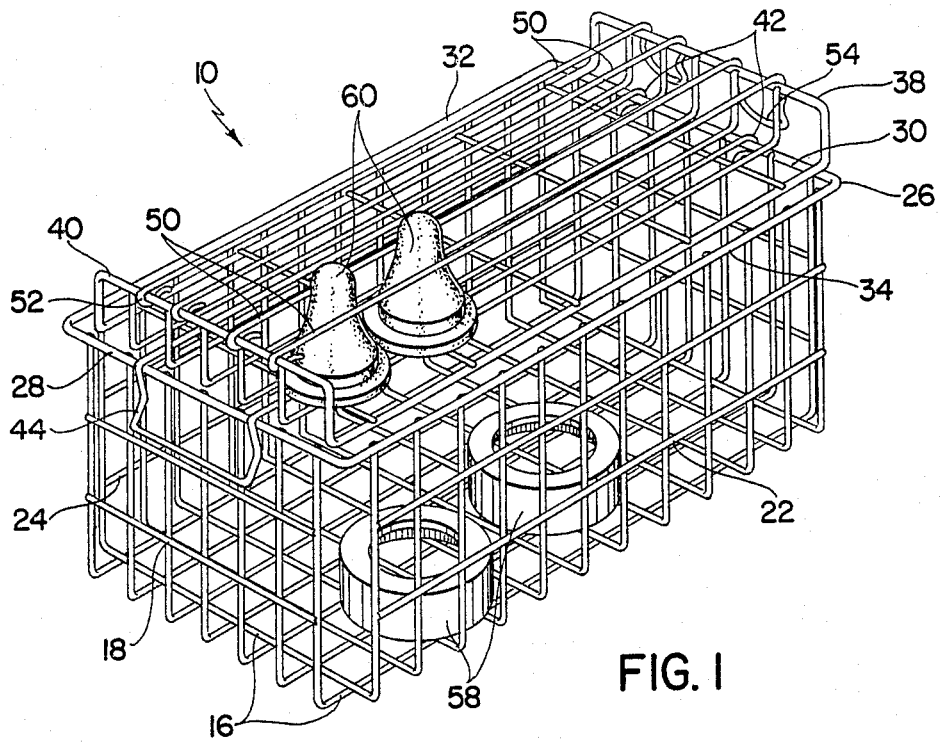
FIG. 1 is a perspective view of a dishwasher basket embodying the present invention.

Referring to the drawings, there is shown generally at 10 a dishwasher basket for baby-bottle parts comprising a bottom container 12 and a top container 14. As will be seen most clearly in FIG. 1, the basket 10 is of a wire-rack construction so that all surfaces thereof are perforate in order that water may freely flow through the basket during the washing and rinsing cycles of the dishwasher. Preferably, the wire-rack construction comprises steel wire coated with a vinyl covering so as to minimize rust and scratching of other utensils that may be in the dishwasher at the same time and that may come into engagement with the basket 10.

Bottom container 12 comprises a bottom wall 16, end walls 18, 20, and sidewalls 22, 24. A rectangular wire 26 defines the top edge of bottom container 12, said top edge having end portions 28, 30 and side portions 32, 34.

Top container 14 comprises a bottom wall 36 and end walls 38, 40. Some of the longitudinal wires that form a part of bottom wall 36 are reversely bent as at 42 and are dimensioned so as to releasably snap onto edge 30 in order pivotally interconnect top container 14 to bottom container 12. In FIG. 1 two such hinge means 42 are illustrated, and at the opposite ends of those wires there is provided an integral, downwardly extending clasp member 44 having an intermediate detent portion 46, whereby when top container 14 is swung downwardly from the position illustrated in FIG. 2 to the position illustrated in FIG. 1, the clasp 44 resiliently engages top edge 28 to maintain top container 14 in closed position with respect to bottom container 12. In such position, it will be seen that the bottom wall 36 of top container 14 functions as a cover for the bottom container 12.

Top container 14 also comprises a pair of spaced wire assemblies 48, each of which comprises a pair of spaced, generally parallel wires 50 reversely bent at one end as at 52, said reversely bent ends engaging the upper edge of end wall 40 so as to effect a pivotal interconnection therewith. The reversely bent ends 52 engage the top edge of end wall 40 in precisely the same manner as do the reversely bent portions 42 engage upper edge 30, i.e., they are snap-received thereon so as to effect the desired pivotal interconnection but at the same time so as to permit ready detachment of the assemblies 48 from top container 14. At their opposite extremities, the assemblies 48 each comprise a downwardly extending clasp 54 having a detent portion 56, whereby when the assemblies 48 are swung downwardly as illustrated in FIG. 1, the clasps 54 resiliently engage the top edge of end wall 38 so as to maintain the assemblies 48 in their operative positions.

Figure 2:
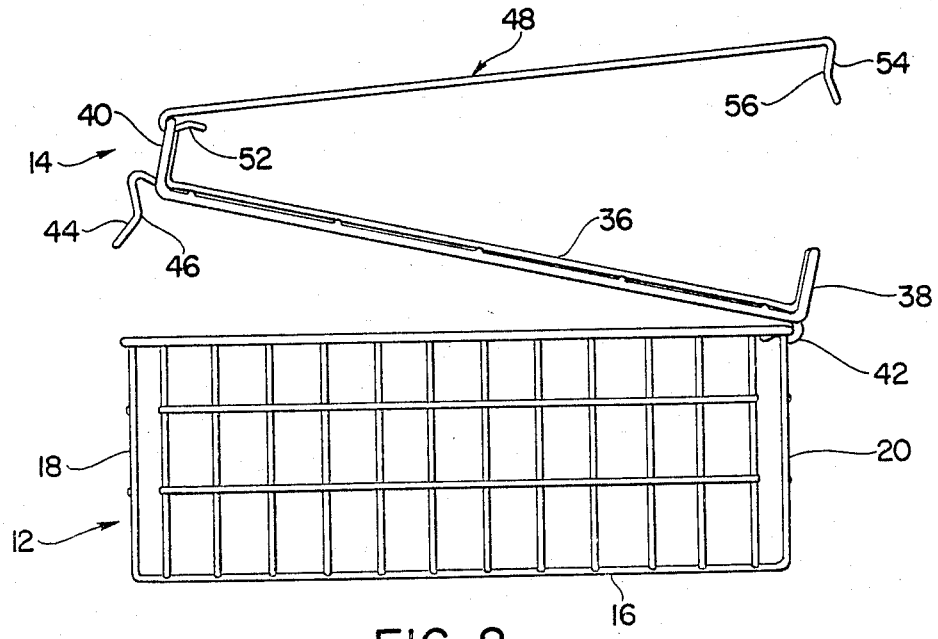
FIG. 2 is a side elevational view thereof with the top container in partially open relation to the bottom container and with the spaced wires of the top container in partially open position.

In operation and use, the top container 14 is swung upwardly to its open position, as illustrated in FIG. 2, whereupon the desired bottle parts, such as, for example, collars 58, may be positioned in the bottom container 12, and after loading thereof, the top container 14 is swung downwardly until clasp 44 engages top edge 28 so as to effectively close the top of bottom container 12. At this point nipples, such as illustrated at 60 in FIG. 1, are positioned on bottom wall 36 and are aligned so that when the wire assemblies 48 are swung downwardly to their closed position as illustrated in FIG. 1, the teat portions of the nipples extend between the spaced wires whereby the nipples are maintained in place in top container 14 during the washing, rinsing and drying cycles of the dishwasher. Thus, the relatively soft and lightweight nipples are segregated from the harder and heavier bottle parts that are mounted in bottom container 12, which obviously is beneficial to the nipples. Although the clasp portions 54 function to interconnect the spaced wires of each assembly 48, the opposite ends of the wires, i.e., the ends having the reversely bent portion 52, may be slid laterally to some extent along the top edge of end wall 40 so as to adjust the spacing between each pair of spaced wires to effectively accommodate the nipples positioned therebetween. Also, the removability of top container 14 from bottom container 12 and of the assemblies 48 from top container 14 is beneficial in the storage, packaging and shipping of the baskets 10.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A dishwasher basket for baby-bottle parts comprising a bottom container having perforate bottom, side, and end walls, a top container having perforate bottom and end walls, means pivotally connecting one end of said top container bottom wall to the upper edge of one of said bottom container end walls, clasp means at the opposite end of said top container bottom wall releasably engaging the upper edge of the opposite end wall of said bottom container whereby when said top container bottom wall is in its closed position, it functions as a cover for said bottom container, and a pair of spaced, substantially parallel wires extending from the upper edge of one of said top container end walls to the upper edge of the opposite top container end wall, said wires having pivot means at one end thereof for effecting a pivotal connection to the upper edge of one of said top container end walls and having clasp means at their opposite ends for releasably engaging the upper edge of the other of said top container end walls, the spacing between said wires being such that the teat end of a nipple may extend therebetween while at the same time retaining said nipple in said top container.

2. The dishwasher basket of claim 1 further characterized in that said top and bottom containers are of wire rack construction.

3. The dishwasher basket of claim 2 further characterized in that the means that pivotally interconnect the top container to the bottom container and the spaced wires to the top container comprise reversely bent portions snap-received on the adjacent top edges, whereby the top container is readily removable from the bottom container, and the spaced wires are readily removable from the top container.

4. The dishwasher basket of claim 3 further characterized in that the clasp ends of said spaced wires comprise a downwardly extending interconnecting wire, whereby said spaced wires form a single unit, the pivot ends of said wires being independently movable laterally along the upper edge to which they are pivotally connected, so that the spacing between said wires may be adjusted.

5. The dishwasher basket of claim 4 further characterized in that there are two spaced wire units in side-by-side relation pivotally mounted on said top container.

* * * * *